US006959681B2

(12) United States Patent
Saito

(10) Patent No.: US 6,959,681 B2
(45) Date of Patent: Nov. 1, 2005

(54) ENGINE STARTER

(75) Inventor: Morihiro Saito, Tokyo (JP)

(73) Assignee: Kyodo Rubber Industries Co., Ltd., Tokyo (JP)

( * ) Notice: Subject to any disclaimer, the term of this patent is extended or adjusted under 35 U.S.C. 154(b) by 0 days.

(21) Appl. No.: 10/782,540

(22) Filed: Feb. 19, 2004

(65) Prior Publication Data

US 2004/0177823 A1 Sep. 16, 2004

(30) Foreign Application Priority Data

Feb. 19, 2003 (TW) ..... 92103430 A
Mar. 4, 2003 (JP) ..... 2003-057325

(51) Int. Cl.[7] ..... F02N 3/02
(52) U.S. Cl. ..... 123/185.3
(58) Field of Search ..... 123/185.14, 185.2, 123/185.3, 185.4

(56) References Cited

U.S. PATENT DOCUMENTS 5,287,832 A * 2/1994 Uhl ..... 123/185.3
2004/0084004 A1 * 5/2004 Tsunoda et al. ..... 123/185.3

FOREIGN PATENT DOCUMENTS

JP 07174061 A 7/1995

* cited by examiner

*Primary Examiner*—Andrew M. Dolinar
(74) *Attorney, Agent, or Firm*—Patterson, Thuente, Skaar & Christensen, P.A.

(57) ABSTRACT

An engine starter includes a reel to be rotated by a rope wound around the reel, first and second springs, both of which being wound up by the rotation of the reel, an engine starting pulley to be rotated by the second spring for driving a crank shaft of an engine, and a centrifugal clutch inserted between the engine starting pulley and the crank shaft of the engine. A spring force accumulated in the second spring is dwindled into zero when the rope is recoiled around the reel by the first and the second springs.

6 Claims, 2 Drawing Sheets

ENGINE STARTER

BACKGROUND OF THE INVENTION

This application claims priority to Taiwan Application No. 92103430 filed Feb. 19, 2003, and Japanese Application No. 57325/2003 filed Mar. 4, 2003, each of said applications incorporated herein by reference in their entirety.

1. Field of the Invention

The present invention relates to an engine starter and, more particularly, relates to an engine starter wherein a spring force accumulated in a spiral spring for driving a crank shaft of an engine can be dwindled into zero when a recoiling of a rope is completed.

2. Description of the Prior Art

In the conventional engine starter, such as a so-called recoil starter, an engine starting pulley is rotated by pulling manually a rope wound around the pulley, and the rotation of the pulley is transmitted to a crank shaft of an engine through a centrifugal clutch. In such recoil starter, however, a large pulling force must be applied rapidly to the rope, and accordingly it is difficult to operate positively by a person of feeble strength.

Further, in case that the engine is an internal combustion engine, air pressure in the engine cylinder is fluctuated, and accordingly it is difficult to pull the rope of the conventional recoil starter smoothly and easily according to the load.

In the other conventional engine starter as disclosed in the Japanese Patent Application Laid-Open No. 174061/95, a spiral spring for driving the engine and a one-way clutch are used, and a rope is pulled manually several times to accumulate the spring force in the spiral spring so as to drive the engine.

In such engine starter, however, a large spring power remains in the spiral spring before the engine is started, so that if the load of the crank shaft of the engine is reduced, the engine is stated by the spring power inadvertently. Such reduction of the load is generated, for example, if the air in the combustion room leaks from the split ring around the piston, and the pressure in the combustion room is reduced when the air in the combustion room is compressed according to the elevation of the piston of the internal combustion engine.

Further, the probability of the unexpected engine start is increased due to the increase and decrease of the fuel flow.

SUMMARY OF THE INVENTION

In order to solve the forgoing problem in the conventional engine starter, it is an object of the present invention to provide an engine starter comprising a reel to be rotated by a rope wound around the reel, a first spring, a second spring, both of the first and second springs being wound up by the rotation of the reel, an engine starting pulley to be rotated by the second spring for driving a crank shaft of an engine, and a centrifugal clutch inserted between the engine starting pulley and the crank shaft of the engine, wherein a spring force accumulated in the second spring is dwindled into zero when the rope is recoiled around the reel by the first and the second springs.

Another object of the present invention is to provide an engine starter further comprising means for connecting directly the engine starting pulley and the reel, wherein the crank shaft of the engine can be driven by the pulling force of the rope through the reel.

Further object of the present invention is to provide an engine starter further comprising a cover connected to the reel so as to be positioned between the engine starting pulley and the second spring.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DESCRIPTION OF THE PREFERRED EMBODIMENT

Figure 1:
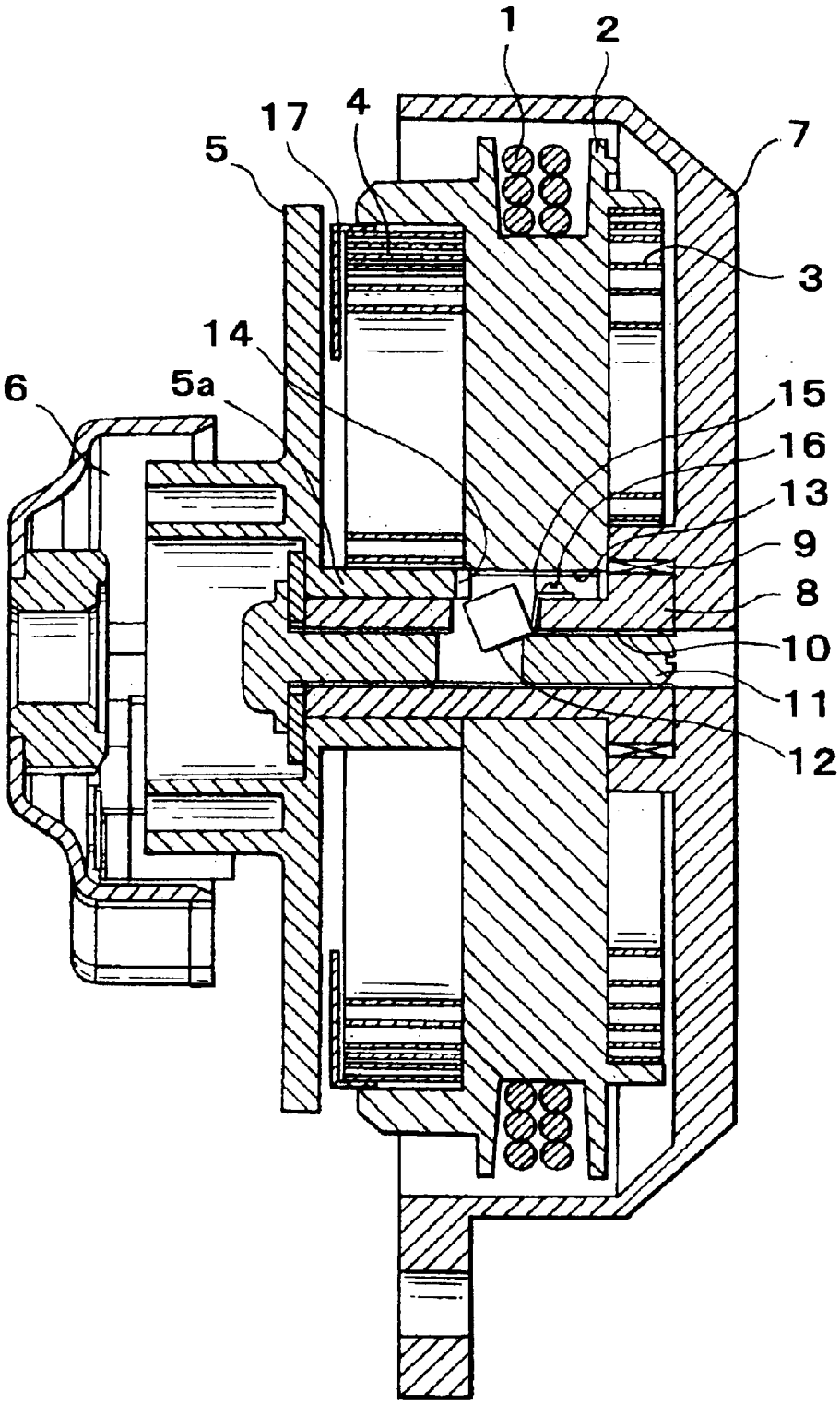
FIG. 1 is a vertically sectional view of an engine starter of the present invention, wherein a reel and an engine starting pulley are not connected together.

The present invention will now be explained with reference to the drawings. FIG. 1 shows an engine starter according to the present invention. In FIG. 1, reference numeral 1 denotes a rope to be pulled manually, 2 denotes a reel to be rotated by the rope 1 wound around thereon, 3 denotes a first spiral spring arranged at one side of the reel 2, 4 denotes a second spiral spring arranged at the other side of the reel 2, 5 denotes an engine starting pulley to be driven by the second spiral spring 4, 6 denotes a centrifugal clutch inserted between the engine starting pulley 5 and a crank shaft of an engine (not shown), 7 denotes a stationary housing surrounding the engine starter according to the present invention, 8 denotes a cylindrical shaft for supporting rotatably the reel 2 and the engine starting pulley 5 on the stationary housing 7 through oil retaining bearings 9 of sintered metal etc., 10 denotes a female screw provided on an inner peripheral surface of the cylindrical shaft 8, 11 denotes a connecting rod threaded with the female screw 10, 12 denotes a connecting member such as a plate spring for connecting the reel 2 and the engine starting pulley 5 to each other when the connecting member 12 is urged by the connecting rod 11 and moved from a position shown in FIG. 1 to a position shown in FIG. 2, 13 denotes a groove or a projection formed on an inner peripheral surface of the reel 2 so as to engage with a projection or groove formed on the connecting member 12, 14 denotes a groove or a projection formed on one end surface of a cylindrical portion 5*a* of the engine starting pulley 5 so as to engage with a projection or a groove formed on the connecting member 12, 15 denotes an arm mounted on the cylindrical shaft 8 by a bolt 16 for connecting the connecting member 12 with the cylindrical shaft 8, and 17 denotes a cover connected to the reel 2 so as to be positioned between the engine starting pulley 5 and the second spiral spring 4.

One end of the first spiral spring 3 is connected to the reel 2 and the other end of the first spiral spring 3 is connected to the stationary housing 7. One end of the second spiral spring 4 is connected to the reel 2 and the other end of the second spiral spring 4 is connected to the engine starting pulley 5.

According to the engine starter of the present invention, constructed as above, the engine is started as follows.

When the rope 1 is pulled manually, the reel 2 is rotated, so that the first and second spiral springs 3 and 4 are wound up.

The spring force accumulating in the second spiral spring 4 by one manual pulling action of the rope 1 is designed to a value sufficient to drive the crank shaft of the engine, so that the spring force accumulated in the second spiral spring is used to drive the engine and disappeared.

If the manual pulling action of the rope 1 is failed in the course thereof, the spring force accumulated in the second spiral spring 4 is not disappeared, but is used for recoiling the rope 1 through the reel 2, so that the spring force accumulated in the second spiral spring 4 is dwindled into zero.

As stated above, in the engine starter of the present invention, the spring force accumulated in the second spiral spring 4 is disappeared normally, so that the engine is not driven carelessly.

Figure 2:
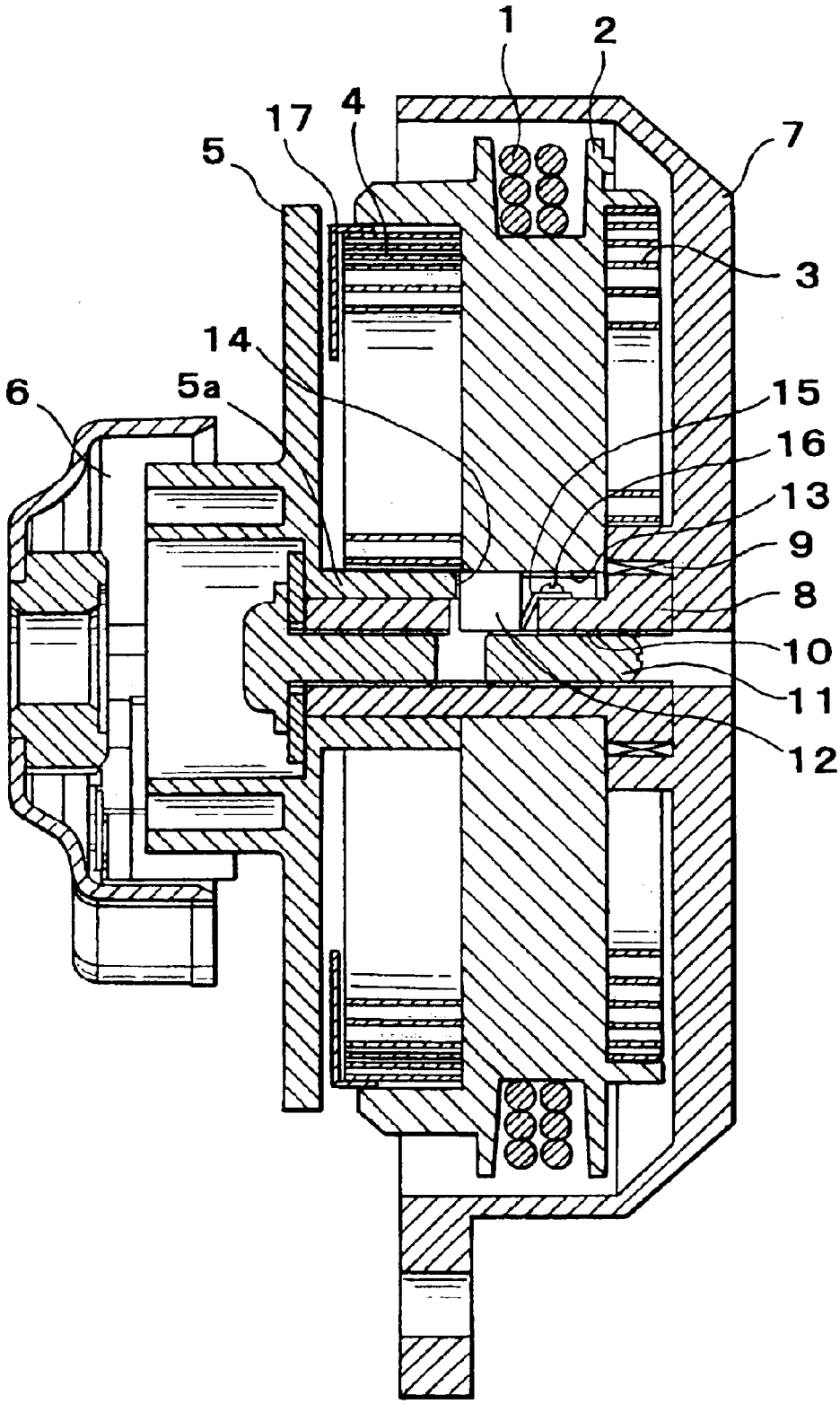
FIG. 2 is a vertically sectional view of an engine starter, wherein a reel and an engine starting pulley are connected together.

Further, in case that the second spiral spring 4 is failed or damaged, the connecting rod 11 is threaded into the cylindrical shaft 8 to urge the plate spring 12 from the position shown in FIG. 1 to the position shown in FIG. 2, so that the reel 2 and the engine starting pulley 5 are connected with each other through the plate spring 12 and the engine can be driven by the manual pulling operation of the rope 1 as a conventional engine starter.

While this invention has been described with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention. The scope of the present invention should be defined by the terms of the claims appended hereto.

What is claimed is:

1. An engine starter comprising a reel to be rotated by a rope wound around the reel, a first spring, a second spring, both of the first and second springs being wound up by the rotation of the reel, an engine starting pulley to be rotated by the second spring for driving a crank shaft of an engine, means for selectively manually connecting together the engine starting pulley and the reel and a centrifugal clutch inserted between the engine starting pulley and the crank shaft of the engine, wherein a spring force accumulated in the second spring is dissipated to zero when the rope is recoiled around the reel by the first and the second springs.

2. The engine starter as claimed in claim 1, further comprising a cover connected to the reel so as to be positioned between the engine starting pulley and the second spring.

3. An engine starter comprising:

a reel to be rotated by a rope wound around the reel, a first spring, a second spring, both of the first and second springs being wound up by the rotation of the reel, an engine starting pulley to be rotated by the second spring to drive a crank shaft of an engine, a connecting member interposed between the engine starting pulley and the reel and being shiftable between an engaged position and a disengaged position wherein in the engaged position connecting member directly rotatably connects the starting pulley to the reel and in the disengaged position the starting pulley and the reel are rotatably connected by the second spring; and a centrifugal clutch inserted between the engine starting pulley and the crank shaft of the engine, wherein a spring force accumulated in the second spring is dissipated to zero when the rope is recoiled around the reel by the first and the second springs.

4. The engine starter as claimed in claim 3, in which the connecting member comprises a plate spring.

5. The engine starter as claimed in claim 3, further comprising a connecting rod capable of moving the connecting member into the engaged position.

6. The engine starter as claimed in claim 5, in which the connecting rod comprises a manually operable screw.

* * * * *